US008887936B2

(12) United States Patent
Ekkert

(10) Patent No.: US 8,887,936 B2
(45) **Date of Patent: *Nov. 18, 2014**

(54) CLOSURE FOR USE IN HOT-FILL CONTAINERS

(75) Inventor: Len Ekkert, Lemont, IL (US)

(73) Assignee: Phoenix Closures, Inc., Naperville, IL (US)

( * ) Notice: Subject to any disclaimer, the term of this patent is extended or adjusted under 35 U.S.C. 154(b) by 255 days.

This patent is subject to a terminal disclaimer.

(21) Appl. No.: 13/105,718

(22) Filed: May 11, 2011

(65) Prior Publication Data

US 2012/0285959 A1 Nov. 15, 2012

(51) Int. Cl.

| | |
|---|---|
| ***B65D 53/00*** | (2006.01) |
| ***B65D 41/04*** | (2006.01) |
| ***B65D 79/00*** | (2006.01) |

(52) U.S. Cl.

CPC ..... *B65D 41/045* (2013.01); *B65D 79/005* (2013.01); *B65D 2543/00092* (2013.01); *B65D 2543/0024* (2013.01); *B65D 2543/00296* (2013.01); *B65D 2543/00527* (2013.01); *B65D 2543/00537* (2013.01)

USPC ..... 220/232; 220/256.1; 220/255.1; 220/254.1; 220/221; 215/351; 215/350; 215/349; 215/343; 215/341

(58) Field of Classification Search

CPC ..... B54D 2543/00092; B54D 2543/0024; B54D 2543/00296; B54D 2543/00521; B54D 2543/00537; B54D 41/00; B54D 41/0435; B54D 41/045; B54D 51/00; B54D 51/14; B54D 51/145; B54D 51/16; B54D 51/1688; B54D 51/20

USPC ..... 220/203.01, 221, 254.1–254.2, 254.7, 220/254.9, 255.1, 256.1, 304, 232; 215/260, 274, 276, 307, 309, 341, 215/343–345, 349–351, 232, 359.1

See application file for complete search history.

(56) References Cited

U.S. PATENT DOCUMENTS

| | | | | |
|---|---|---|---|---|
| 697,681 | A * | 4/1902 | Smelker | 215/276 |
| 2,041,403 | A | 9/1932 | Fergusson | |
| 2,040,798 | A | 6/1934 | Schoonmaker | |
| 2,135,834 | A * | 11/1938 | Overmyer | 215/276 |
| 2,383,747 | A | 8/1945 | Sharp | |
| 2,424,801 | A | 3/1946 | Crabbe et al. | |
| 2,427,819 | A * | 9/1947 | Thener | 215/276 |
| 3,042,247 | A | 7/1962 | Bonnet | |
| 3,059,800 | A | 10/1962 | Mills | |

(Continued)

OTHER PUBLICATIONS

Office Action regarding U.S. Appl. No. 13/105,692, dated May 19, 2014 (6 pgs).

(Continued)

*Primary Examiner* — Mickey Yu
*Assistant Examiner* — Brijesh V. Patel
(74) *Attorney, Agent, or Firm* — Gerald T. Shekleton; Husch Blackwell LLP

(57) ABSTRACT

An open top closure for use in conjunction with a liner. The closure has sidewalls and the upper portion of the closure is open, with at least one rib positioned a spaced distance above the plane of the liner. When in place on a container, the rib serves to limit the travel of the liner upward as it expands after the hot-fill of a product. The open upper portion of the closure permits any accumulated moisture to be blown off after the hot-fill is cooled.

10 Claims, 4 Drawing Sheets

(56) References Cited

U.S. PATENT DOCUMENTS

| | | | | | |
|---|---|---|---|---|---|
| 3,110,599 | A | | 11/1963 | Kusinski et al. | |
| 3,967,746 | A | | 7/1976 | Botkin | |
| 4,003,489 | A | | 1/1977 | Bingaman | |
| 4,042,143 | A | | 8/1977 | Biggins | |
| 4,121,729 | A | * | 10/1978 | Husum | 215/276 |
| 4,122,964 | A | * | 10/1978 | Morris | 215/260 |
| 4,174,784 | A | | 11/1979 | Hartung | |
| 4,319,690 | A | | 3/1982 | Birrell et al. | |
| 4,446,979 | A | | 5/1984 | Gach et al. | |
| 4,540,099 | A | * | 9/1985 | Swartzbaugh et al. | 215/252 |
| 4,765,499 | A | | 8/1988 | von Reis et al. | |
| 4,984,700 | A | | 1/1991 | Knickerbocker | |
| 5,062,538 | A | | 11/1991 | Ochs | |
| 5,092,477 | A | | 3/1992 | Johnson et al. | |
| 5,096,078 | A | | 3/1992 | McQueeny | |
| 5,169,003 | A | | 12/1992 | Traupman | |
| 5,251,809 | A | | 10/1993 | Drummond et al. | |
| 5,280,842 | A | | 1/1994 | Koo | |
| 5,297,696 | A | * | 3/1994 | Bernstein et al. | 222/83 |
| 5,381,918 | A | * | 1/1995 | Dahl | 220/784 |
| 5,839,592 | A | | 11/1998 | Hayes | |
| 5,927,530 | A | | 7/1999 | Moore | |
| 5,960,992 | A | * | 10/1999 | Bernstein et al. | 222/83.5 |
| 6,202,871 | B1 | | 3/2001 | Kelly | |
| 6,426,046 | B1 | | 7/2002 | Cassells et al. | |
| 7,611,026 | B1 | | 11/2009 | Bloom et al. | |
| 7,721,901 | B1 | | 5/2010 | Von Spreckelsen et al. | |
| 7,780,024 | B1 | | 8/2010 | Marsella et al. | |
| 7,798,319 | B1 | | 9/2010 | Bried et al. | |
| 7,832,579 | B2 | | 11/2010 | Lohrman et al. | |
| 7,938,282 | B1 | * | 5/2011 | Hawry et al. | 215/305 |
| 8,474,634 | B1 | | 7/2013 | Branson et al. | |
| 2002/0079286 | A1 | * | 6/2002 | Haynes et al. | 215/276 |
| 2002/0088811 | A1 | * | 7/2002 | Lu | 220/780 |
| 2004/0084452 | A1 | | 5/2004 | Hsieh | |
| 2005/0236413 | A1 | | 10/2005 | Maciag et al. | |
| 2005/0284837 | A1 | | 12/2005 | Taber et al. | |
| 2006/0091099 | A1 | * | 5/2006 | Klepac et al. | 215/276 |
| 2007/0034593 | A1 | | 2/2007 | Ichimura et al. | |
| 2007/0187352 | A1 | | 8/2007 | Kras et al. | |
| 2008/0302752 | A1 | * | 12/2008 | Farrar et al. | 215/200 |
| 2009/0218351 | A1 | | 9/2009 | Antal, Sr. | |
| 2010/0147848 | A1 | | 6/2010 | Rider, Jr. et al. | |
| 2010/0187245 | A1 | | 7/2010 | Brown | |

OTHER PUBLICATIONS

Office Action regarding U.S. Appl. No. 13/105,692, dated Feb. 12, 2014 (7 pgs).

Office Action regarding U.S. Appl. No. 13/105,692, dated Oct. 9, 2013 (8 pgs).

Office Action regarding U.S. Appl. No. 13/105,692, dated Aug. 14, 2013 (8 pgs).

Office Action regarding U.S. Appl. No. 13/105,692, dated Apr. 10, 2013 (8 pgs).

Office Action regarding U.S. Appl. No. 13/527,255, dated Aug. 14, 2013 (10 pgs).

Office Action regarding U.S. Appl. No. 13/527,255, dated Oct. 22, 2013 (11 pgs).

Office Action regarding U.S. Appl. No. 13/527,255, dated Apr. 11, 2013 (12 pgs).

U.S. Notice of Allowance dated Jul. 3, 2014 for corresponding U.S. Appl. No. 13/105,692 (publication US 2012-0285965 A1, published Nov. 15, 2012).

U.S. Notice of Allowance dated Jun. 10, 2014 for corresponding U.S. Appl. No. 13/527,255 (publication US 2013-0334225 A1, published Dec. 19, 2013).

* cited by examiner

CLOSURE FOR USE IN HOT-FILL CONTAINERS

BACKGROUND OF THE INVENTION

1. Field of the Invention

The present invention relates generally to container closures, and more particularly to closures with liners for use in hot-fill containers.

2. Background of the Invention

When hot-filling a container, the container is capped when the contents are at an elevated temperature. The container is manipulated to ensure the hot contents eliminate any biological contaminants in the container. At the elevated temperature, the container bulges. When the contents cool, the volume of any gas in the container is reduced, which can cause the bulging container to flex inwardly slightly past its original blown dimensions. When the product requires that a liner be used, additional risks are encountered with hot-fill contents. When the contents cool, the liner may be pulled inwardly sufficiently to break the seal about the mouth sealing surface.

Further, the liner may retain water on top, for example, when the container is sprayed as a part of the cooling process. Retained water may then run out from the liner when the customer tears it off.

Also, the retained water may support the growth of bacteria on the liner as mold, which would present the consumer with an unsightly and an unsanitary situation on opening the food container for the first time.

SUMMARY OF THE INVENTION

In accordance with the present invention, there is provided an open top closure for use in conjunction with a liner. The closure has sidewalls with interior threads or a snap-on rib, as desired. The upper portion of the closure is open, with at least one rib positioned a spaced distance above the liner. When in place on a container, the rib serves to limit the travel of the liner upward as it expands after the hot-fill of a product. The open top of the closure allows moisture that may accumulate on the liner from the subsequent cooling of the container and product to be blown away.

BRIEF DESCRIPTION OF THE DRAWINGS

The present invention will be more readily apparent from the following detailed description of the invention and the appended claims, when taken in conjunction with the accompanying drawings in which:

DETAILED DESCRIPTION OF THE PREFERRED EMBODIMENTS

Figure 1:
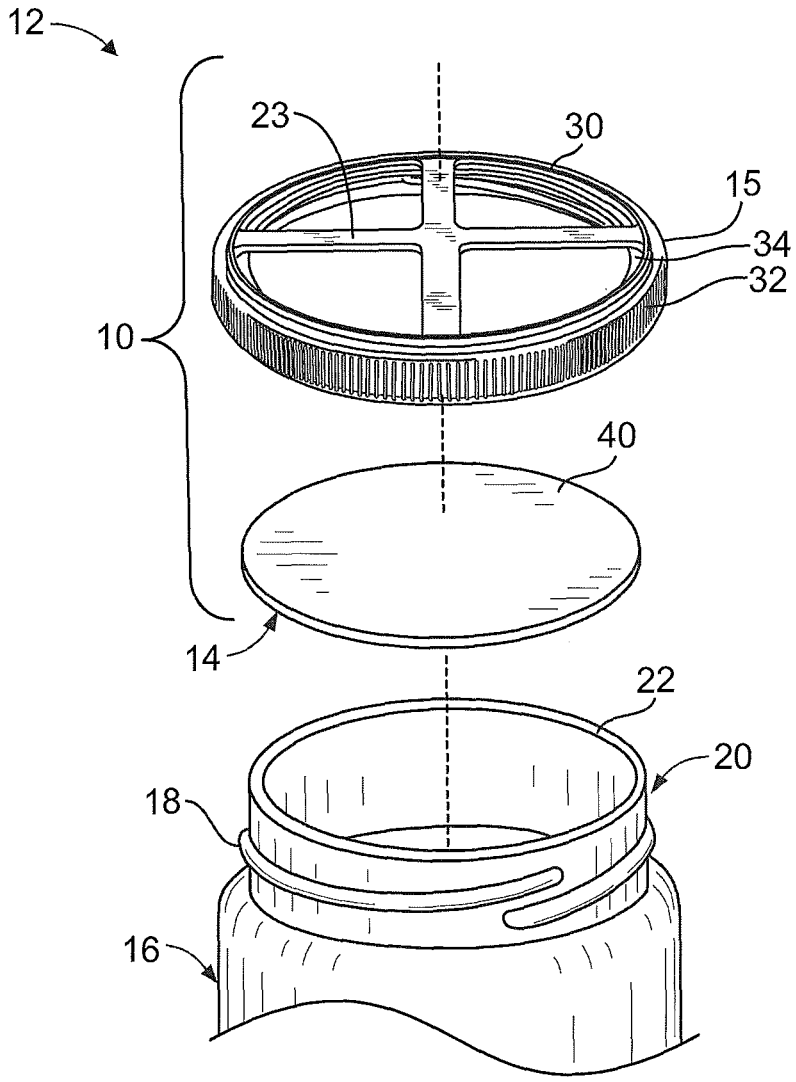
FIG. 1 is an exploded perspective view of a closure, liner and an associated container in accordance with the subject invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the figures and particularly to FIG. 1, there is shown a closure package 10 including a closure 12 and a liner 14 in a typical container cap and liner. The closure 10 is for use with an associated container 16. The exemplary container 16 has a threaded neck portion 18 with a finish 20. The finish 20 is that portion of the container 16 including the upper region which engages the cap 12, e.g., the threaded area 18 and an uppermost sealing surface 22 of the container 16. The container threads 18 engage complementary threads 36 (FIG. 2) formed on an inner surface of the closure 15. It will be recognized by those skilled in the art that the closure package 10 described herein can also be used with containers having a snap-like or beaded engagement configuration, in addition to the threaded closure described therein.

Figure 2:
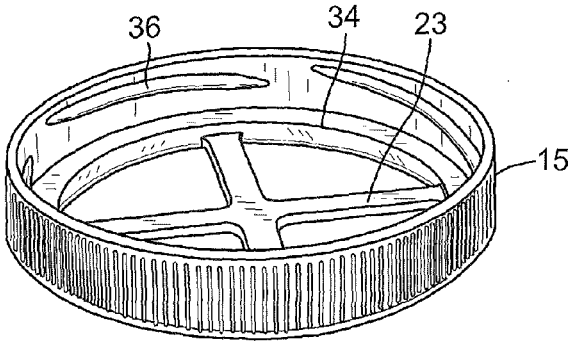
FIG. 2 is a bottom perspective view of the bottom piece of the two piece closure of FIG. 1.
Figure 9:
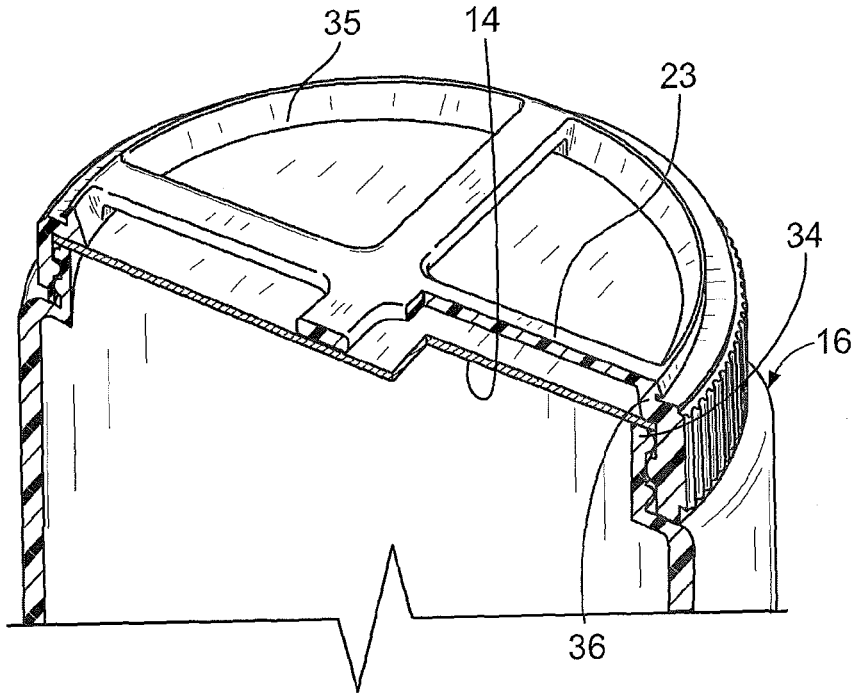
FIG. 9 is a cut-away view of the lower portion of the closure, a liner and the container.

The lower portion of the closure 15 has a top mostly open portion 30 with cross bars or ribs 23 positioned generally perpendicular to one another, although they may be at 70° to 110° to one another or parallel, as will be explained. A skirt portion 32 depends from the top portion 30. An inner shoulder 34 adjacent the skirt portion 32 is adapted to coact with the sealing surface 22 of the container 16 to form a seal therebetween, as will be seen (FIG. 2). When the package is assembled, the liner 14 comprises a circular disc and resides between the sealing flange 34 of the cap 12 and the sealing surface 22 of the container 16, spanning the opening or mouth 36 of the container 16. The sealing surface 22 presents a flat surface for sealing on the lower side, with a tapered upper surface 35 to the upper circumference of the closure (FIG. 9) as an aid in release of the part from the mold. Further, each rib tapers out at the juncture with the closure circumference as shown in FIG. 9, again, as an aid in release of the part from the mold.

Figure 6:
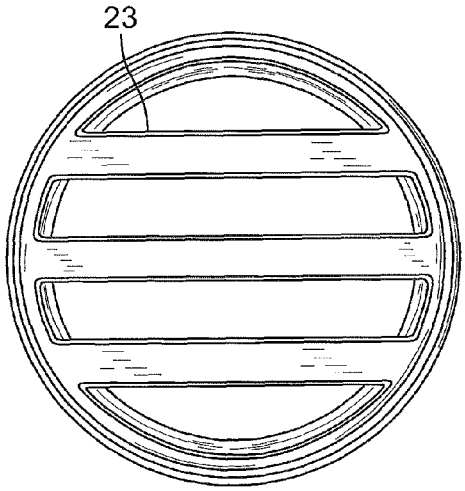

The liner 14 has a central portion 40 that is positioned over and in use, sealed at its circumference to the sealing surface 22 of the container 16. In normal (room temperature) use, the liner remains spaced from the ribs, as seen in FIGS. 6 and 11.

In one embodiment the liner 14 is formed from a laminate material having a resilient substrate layer, a foil or like gas-impermeable layer, and a heat activated bonding layer, such as a heat activated adhesive. In a current embodiment, the resilient substrate layer is a closed cell foam material, but can be chip board or paper backed and/or coated and is relatively impervious to the environs and establishes a substantially air-tight seal between the container 16 contents and the environs. The resilient material layer permits the cap 12 to be closely fitted to, and tightened onto, the container 16.

In a process of filling and capping a container in a hot-fill process, the container is first filled with the hot product, and then a liner is placed over the mouth of the container and heat-sealed. While the product is still hot or warm, the air in the space above the product expands, pushing the liner outward. If there is nothing in place to contain the bulging liner, the seal of the liner on the mouth can be broken. The container with cap and liner in place is then cooled by spraying with cold water. The container is therefore capped as soon as possible after the placement of the liner on the container. The closure is then screwed or pressed down to maintain the liner in place and complete the seal. If water is not completely blown off the liner before the cap is in place, there may be microbial and/or fungal growth on the liner when the ultimate user of the product opens the container. The discovery of such a condition by a consumer would result in ill will towards the retailer and the manufacturer, as well as result in decreased sales. Applicant's closure will not only retain the outward bulge of the liner and thereby assist in maintaining the seal, but will also allow a blast of air to blow away any moisture which may have accumulated during the cooling process, thereby averting any microbial or fungal growth.

Figure 3:
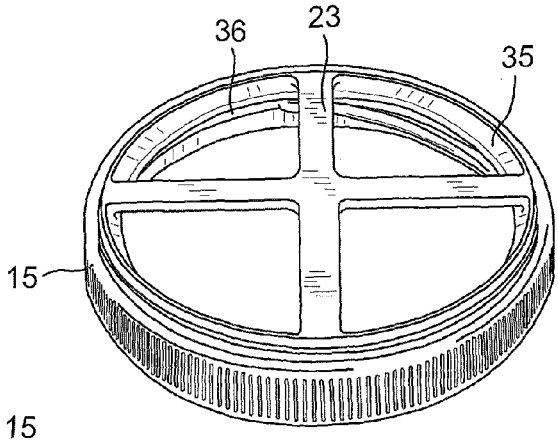
FIG. 3 is an upper perspective view of the closure of FIG. 1.
Figure 4:
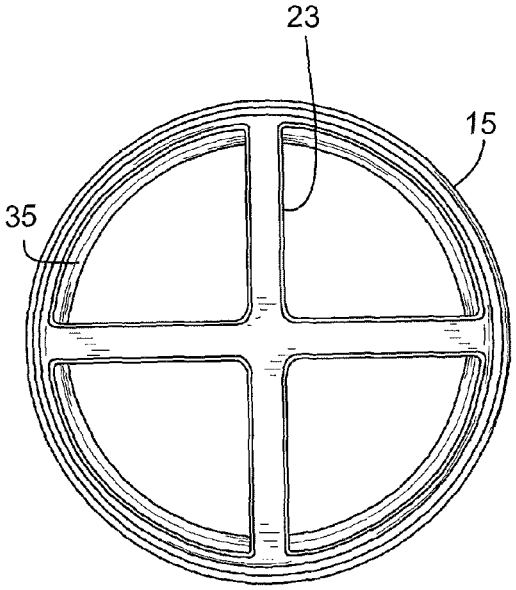
FIG. 4 is a top view of the closure of FIG. 1.

As shown in FIG. 3, the ribs are vertically spaced from the top of the liner when the liner is not under positive pressure from the product in the container. At least one rib, preferably two crossing ribs 23 extend across opening 30 of the closure 15. The ribs are attached to the upper portion of the closure 15.

Thus, the ribs 23 are spaced 1 to 5 mm above the liner, thereby leaving sufficient open/upper space in the closure so that passage of the closure and container assembly past a blower will effectively eliminate moisture residing on the liner.

Figure 5:
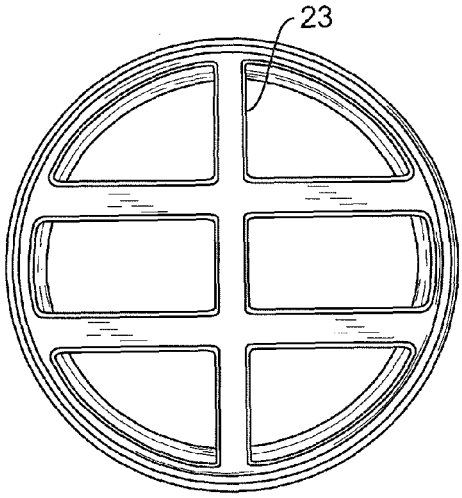
FIGS. 5, 6 and 7 are top views of alternate configurations of the closure of FIG. 1.
Figure 7:
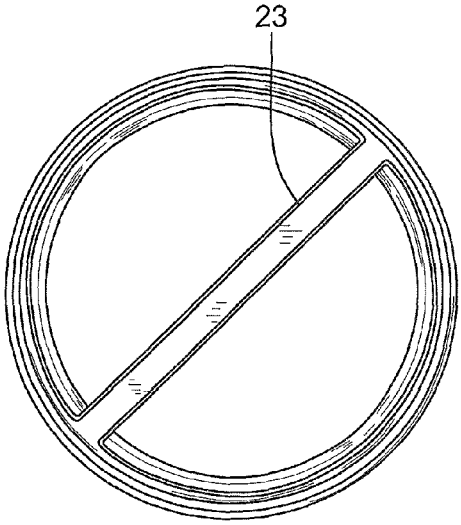
Figure 8:
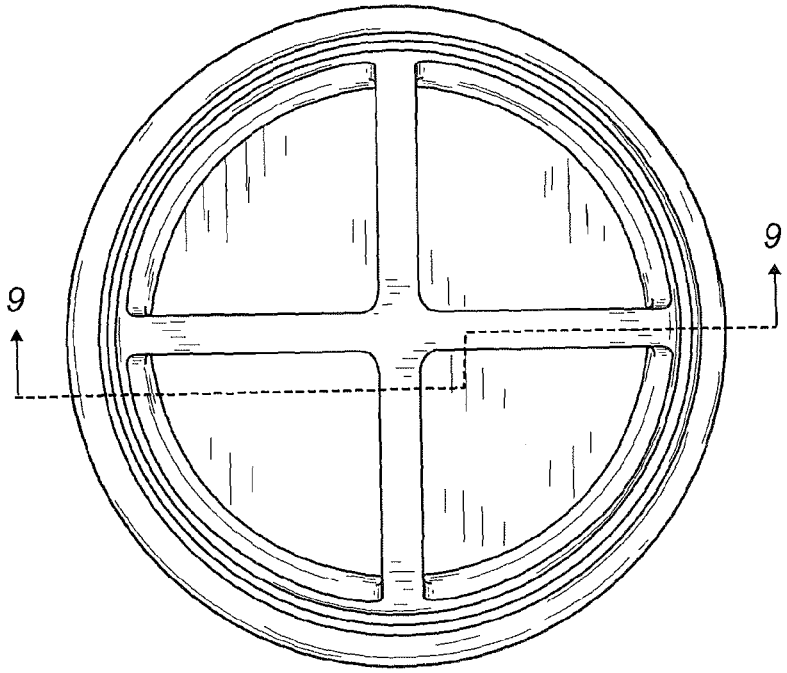
FIG. 8 is a top view of a portion of the closure, showing the liner beneath.

Instead of crossing ribs as shown in FIG. 2, other configurations, such as parallel (FIG. 6), grid (FIG. 5), or a single rib (FIG. 7) may be used.

It will be understood that the foregoing description is of preferred exemplary embodiments of the invention and that the invention is not limited to the specific forms shown or described herein. Various modifications may be made in the design, arrangement, and type of elements disclosed herein, as well as the steps of making and using the invention without departing from the scope of the invention as expressed in the appended claims.

The invention claimed is:

1. A container assembly comprising a closure, a container and a resilient liner, said closure comprising:

a sealing shoulder on the closure for maintaining the resilient liner against a mouth of the container to maintain a seal over the mouth, said closure having an opening on an upper end and a crossbar spanning the opening;

said resilient liner being in a plane over said mouth;

said crossbar being spaced from said plane and said resilient liner over the length of said crossbar to allow expansion upward of said resilient liner, so that upon expansion of said resilient liner upward with the application of heat to the container, the crossbar limits travel of the resilient liner while maintaining the seal and access to the resilient liner.

2. The container assembly of claim 1 wherein the resilient liner is a foil composite liner.

3. The container assembly of claim 1 wherein there are at least two crossbars disposed perpendicular to each other.

4. The container assembly of claim 1 wherein there are a plurality of crossbars disposed parallel to each other.

5. The container assembly of claim 1 wherein the crossbar is spaced from 1 to 5 mm above the plane of the resilient liner.

6. A container assembly comprising a closure, a container and a liner, said closure having a shoulder that pushes the liner against a mouth of the container to effect a seal, said closure having an opening on an upper end and a crossbar spanning the opening and contacting a periphery of the closure at opposing ends; a portion of the crossbar tapering on an underside of the crossbar at opposing ends to contact said periphery;

said resilient liner being in a plane over said mouth; and said crossbar being spaced from said plane and said liner.

7. The container assembly of claim 6 wherein there are at least two crossbars disposed perpendicular to one another.

8. The container assembly of claim 6 wherein there are at least two crossbars disposed parallel to one another.

9. The container assembly of claim 6 wherein the resilient liner is a foil composite liner.

10. The container assembly of claim 6 wherein the crossbars is spaced 1 mm to 5 mm above the resilient liner.

* * * * *